US005465542A

United States Patent [19]

Terry

[11] Patent Number: 5,465,542

[45] Date of Patent: Nov. 14, 1995

[54] INTERBLOCKING CONCRETE FORM MODULES

[76] Inventor: Verl O. Terry, 2647 Scenic Dr., Idaho Falls, Id. 83406

[21] Appl. No.: 171,242

[22] Filed: Dec. 20, 1993

Related U.S. Application Data

[63] Continuation of Ser. No. 891,558, May 29, 1992, abandoned.

[51] Int. Cl.[6] ..... E04B 2/34

[52] U.S. Cl. ..... 52/309.7; 52/309.12; 52/309.16; 52/431; 52/376

[58] Field of Search ..... 52/309.12, 309.7, 52/309.16, 309.17, 309.2, 404, 405, 730.2, 426, 431, 432, 600, 601, 602, 422, 373, 368, 376, 730.6

[56] References Cited

U.S. PATENT DOCUMENTS

| | | | |
|---|---|---|---|
| 880,820 | 3/1908 | Pierson . | |
| 3,313,073 | 4/1967 | Matthews | 52/376 |
| 3,552,076 | 1/1971 | Gregori | 52/309.12 |
| 3,788,020 | 1/1974 | Gregori | 52/309 |
| 3,828,502 | 8/1974 | Carlsson | 52/309.11 |
| 3,872,636 | 3/1975 | Nicosia | 52/364 |
| 3,918,223 | 11/1975 | Carlsson | 52/731.5 |
| 3,922,828 | 12/1975 | Patton | 52/368 |
| 3,983,673 | 10/1976 | Camus | 52/601 X |
| 4,223,501 | 9/1980 | DeLozier | 52/309.11 |
| 4,226,061 | 10/1980 | Day, Jr. | 52/122 |
| 4,516,372 | 5/1985 | Grutsch | 52/309.12 |
| 4,604,843 | 8/1986 | Ott et al. | 52/426 |
| 4,633,634 | 1/1987 | Nemmer et al. | 52/601 X |
| 4,698,947 | 10/1987 | McKay | 52/309.12 |
| 4,706,429 | 11/1987 | Young | 52/309.12 |
| 4,731,968 | 3/1988 | Obino | 52/309.12 |
| 4,879,855 | 11/1989 | Berrenberg | 52/309.11 |
| 4,981,003 | 1/1991 | McCarthy | 52/309.7 |
| 5,067,296 | 11/1991 | Brown et al. | 52/309.7 |
| 5,189,856 | 3/1993 | Windstrup | 52/309.12 |

FOREIGN PATENT DOCUMENTS

| | | | |
|---|---|---|---|
| 2394647 | 2/1979 | France | 52/309.12 |
| 4000956 | 2/1991 | Germany | 52/600 |

*Primary Examiner*—Carl D. Friedman
*Assistant Examiner*—Kein T. Nguyen
*Attorney, Agent, or Firm*—Christensen, O'Connor, Johnson & Kindness

[57] ABSTRACT

Interlocking concrete form modules (21) suitable for creating a concrete wall form is disclosed. The modules (21) have the general shape of a right rectangular parallelepiped with parallel side walls (23*a*, 23*b*) joined by integral webs (25*a*, 25*b*, 27*a*, 27*b*, 27*c*) that define a plurality of parallel elongate cavities (31). The edges of the side walls (23*a*, 23*b*) include tongues (33*a*, 33*b*) and grooves (35*a*, 35*b*) that allow the modules (21) to be interlocked to form a wall. The ends of the webs are undercut such that cavities between the modules are created when the modules are suitably interlocked. The between-the-module cavities lie orthogonal to the through-the-module cavities. The modules (21) are formed of an insulating material and left in place. Preferably, the tongues along one edge include notches aligned with the webs. In one embodiment, the modules (21) substantially entirely are formed of relatively dense (3–5 lb./ft.$^3$) expanded polystyrene (EPS). The density of the EPS is adequate to hold threaded wall anchors. In an alternate embodiment, the modules (41) are formed of less dense (approximately 1.5 lb./ft.$^3$) EPS and include embedded nonmetallic attachment elements (55, 57) that are sized and positioned such that surfaces of the attachment elements lie coplanar with the outer surfaces of the side walls (43*a*, 43*b*) of the modules (41). Preferably, the nonmetallic attachment elements (55, 57) span substantially the entire height of the modules to create equi-spaced furring strips that cover substantially the entire height of a wall formed when the modules are suitably assembled.

15 Claims, 6 Drawing Sheets

INTERBLOCKING CONCRETE FORM MODULES

This application is a continuation application based on prior application Ser. No. 07/891,558, filed on May 29, 1992 now abandoned.

TECHNICAL AREA

This invention relates to concrete wall forms and, more particularly, to interlocking concrete form modules designed to be left in place to provide permanent insulation and an attachment medium for wall covering.

BACKGROUND OF THE INVENTION

In the past, various types of concrete wall forms have been proposed. Some of the proposed forms are designed to be left in place and provide an attachment medium for wall coverings. Many comprise a plurality of modules designed to be assembled together to form a wall. See U.S. Pat. Nos. 3,552,076 entitled CONCRETE FORM; 3,788,020 entitled FOAMED PLASTIC CONCRETE FORM WITH FIRE-RESISTANT TENSION MEMBER; 4,223,501 entitled CONCRETE FORM; and 4,879,855 entitled ATTACHMENT AND REINFORCEMENT MEMBER FOR, MOLDED CONSTRUCTION FORMS. After assembly, concrete is poured into cavities in the form. If desired, reinforcing metal is added prior to pouring the concrete.

While modular concrete forms of the type described in the foregoing United States patents may be usable under some circumstances, they all have disadvantages. Specifically, prior art modular concrete forms have generally been formed of low-density expanded polystyrene (EPS), i.e., polystyrene having a density lying in the 1½–2 lb./ft.$^3$ range. While low-density polystyrene has adequate insulation properties, it is structurally weak. The strength of expanded polystyrene having a density falling into the 1½–2 lb./ft.$^3$ range is inadequate to hold screw-type anchors of the type commonly used to attach wall coverings, such as plasterboard and the like. As a result, adhesives must be used to attach wall coverings to concrete forms created entirely from low-density (e.g., 1½–2lb./ft$^3$) EPS, i.e., modular forms of the type described in U.S. Pat. No. 3,552,076, referenced above. For a variety of reasons adhesives are not as desirable as mechanical (e.g., screw) anchors.

One proposal designed to overcome the attachment problem described above is to embed attachment strips in side walls formed of EPS. See U.S. Pat. Nos. 4,223,501 and 4,879,855. The most recent of these patents (U.S. Pat. No. 4,879,855) discloses strips of solid galvanized steel attached to expanded webbed steel cross members embedded in EPS side walls. The solid galvanized steel strips are coplanar with the outer surface of the form, and the expanded steel web reinforces the form. Wall coverings are attached by mechanical fasteners to the solid galvanized steel strips.

While this solution partially improves the attachment problem, it has other disadvantages. Specifically, because of the structural dissimilarities between low-density EPS and steel, it is difficult to cut modules having embedded steel elements in order to meet the requirements of a construction job. More specifically, walls in most construction situations have comers. While most comers are 90° comers, occasionally other angles are required. One way of making corners is to cut concrete form modules to fit. As noted above, this is difficult, if not impossible, when the components of a concrete form module have significant structural dissimilarities.

While one could create a variety of comer interlocking concrete modules in the manner described in U.S. Pat. No. 4,879,855, such modules would be expensive to manufacture. In addition, they would increase inventory costs and, in many instances, not be as readily available as desired, leading to construction delays and increased construction costs.

A further disadvantage of interlocking concrete form modules of the type described in U.S. Pat. No. 4,879,855 is the ease of distorting such modules in a construction environment. Because the EPS is only included in side walls and is not integral throughout the entire module, the expanded metal is occasionally bent or the low-density EPS is cracked or broken, resulting in the side walls becoming misaligned.

Another disadvantage of interlocking form modules of the type described in U.S. Pat. No. 4,879,855 is the tendency to lose the galvanized steel attachment strips during transportation. More specifically, the galvanized steel attachment strips are U-shaped and press fit around the ends of the expanded webbed steel cross members, which are also U-shaped. Frequently, during transportation, the press fit weakens, resulting in the loss of the galvanized steel attachment strips. This is unacceptable in a construction environment because of the resulting loss in time and material.

A related disadvantage is the loss of attachment that can occur under some circumstances. Specifically, the edges of expanded webbed steel cross members, if cut along metal crossing points, have V-shaped open areas between box-shaped closed areas. Anchors that fall in the V-shaped open areas are not laterally attached to the edges of the expanded webbed steel cross members. As a result, if all of the anchors attached to a solid galvanized steel strip fall in V-shaped areas, no lateral attachment to the associated expanded webbed steel cross member exists. As a result a lateral force, i.e., a force parallel to the wall, can detach the solid galvanized steel strip and anything affixed thereto from the associated expanded webbed steel cross member.

As will be better understood from the following discussion, the present invention overcomes the foregoing problems by providing interlocking concrete form modules that are structurally adequate and formed entirely of materials that are easy to cut to meet the comer requirements of construction jobs.

SUMMARY OF THE INVENTION

In accordance with this invention, interlocking concrete form modules suitable for creating a concrete wall form are disclosed. The modules have the several shapes of a right rectangular parallelepiped with parallel sides joined by integral webs that define a plurality of parallel, elongate cavities. The edges of the sides include tongues and grooves that allow the modules to be interlocked to form a wall. The ends of the webs are undercut such that cavities between the modules are created when the modules are suitably interlocked. The between-the-module cavities lie orthogonal to the through-the-module cavities. The modules are formed of an insulating material and left in place. Further, the modules are substantially entirely formed of nonmetallic materials that can be readily cut using construction tools, such as handsaws and hot wire cutting tools, while being capable of receiving and adequately holding threaded anchors.

In accordance with one aspect of this invention, the modules are formed of relatively high-density (3–5 lb./ft.$^3$) expanded polystyrene (EPS). This EPS density is adequate to hold threaded anchors without requiting a separate attachment member.

In accordance with alternate aspects of this invention, the modules are formed of relatively low-density (approximately 1½ lb./ft.$^3$) EPS and include embedded attachment members sized and positioned such that the outer surfaces of the attachment members are coplanar with the outer surfaces of the modules. The attachment members are formed of a nonmetallic material, such as rigid, high impact polyvinyl chloride (PVC), that is adequate to both retain threaded anchors and be easily cut with conventional handsaws, hot wire cutting tools and the like. Preferably, the attachment members span substantially the entire height of the modules to create equi-spaced furring strips that cover substantially the entire height of a wall formed when the modules are suitably assembled. The furring strips are formed and embedded such that they cannot be lost during transportation by being easily separated from the modules in which they are embedded. The furring strips are also formed and embedded such that lateral movement is prevented both before and alter being attached to other elements, such as a vertical alignment 2×4 during wall construction.

In accordance with further aspects of this invention, the attachment members include I-shaped elements positioned and oriented such that the outer surface of one of the flanges of each of the I-shaped elements lies coplanar with one of the outer surfaces of the form modules. Preferably, an I-shaped element is aligned with each interval web of the interlocking concrete form modules.

In accordance with further aspects of this invention, located at each of the comers of the form modules is an end attachment member having the cross-sectional shape of a mathematical square root symbol. The end attachment members are oriented such that the outer surface of the tail of the square root symbol shape lies coplanar with the sides of the modular form.

As will be readily appreciated from the foregoing summary, the invention provides interlocking concrete form modules designed to be assembled together to create a concrete wall form and left in place alter concrete is poured to provide insulation. The modules are formed substantially entirely of nonmetallic materials that can be readily cut using conventional tools, such as handsaws and hot wire cutting tools. Because the modules can be readily cut, they are easily configured to create wall comers of any desired angle, and flush wall ends. In addition, the modules are formed such that screw anchors can be readily used to attach wall coverings, such as plasterboard and the like, to walls alter they are constructed, without the need for additional elements. The ability to apply anchors to both versions of modules formed in accordance with the invention without worrying about lateral movement of elements attached to the modules improves the ease of use of the modules during wall construction.

BRIEF DESCRIPTION OF THE DRAWINGS

The foregoing features and advantages of this invention will become more readily appreciated as the same becomes better understood by reference to the following detailed description, when taken in conjunction with the accompanying drawings, wherein:

FIG. 13 is an elevational view of a plurality of interlocking concrete form modules of the type illustrated in FIGS. 8 and 9 assembled to create a wall.

DETAILED DESCRIPTION OF THE PREFERRED EMBODIMENT

Figure 1:
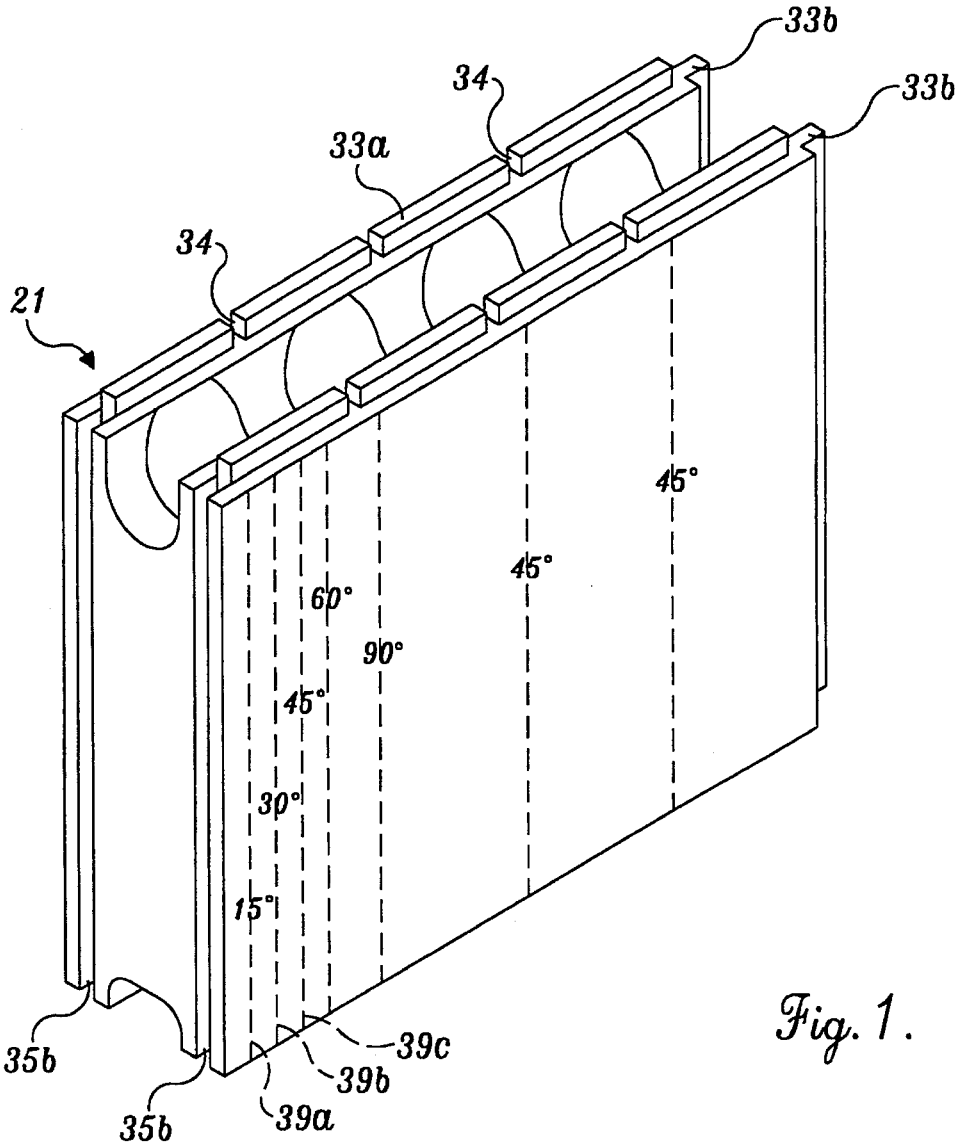
FIG. 1 is a pictorial view of an interlocking concrete form module formed in accordance with the invention.
Figure 2:
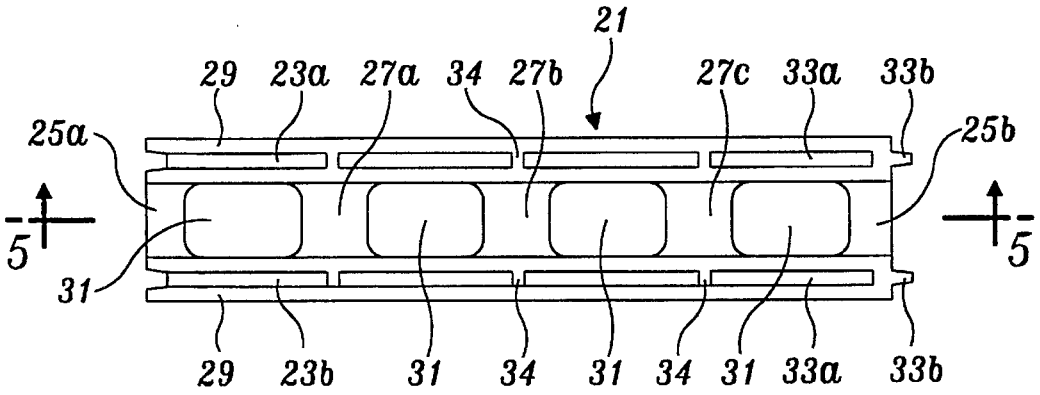
FIG. 2 is a top plan view of the interlocking concrete form module illustrated in FIG. 1.
Figure 4:
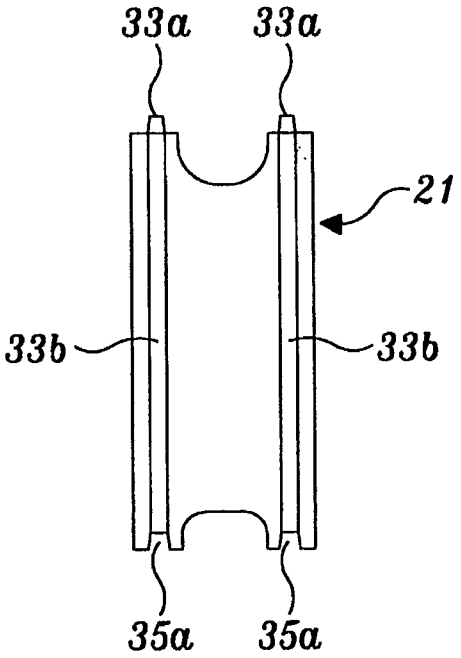
FIG. 4 is an end view of the interlocking concrete form module illustrated in FIG. 1.

FIG. 1 illustrates an interlocking concrete form module 21 formed in accordance with the invention. The interlocking concrete form module 21 illustrated in FIG. 1 is a unitary structure formed substantially entirely of relatively dense (3–5 lb./ft.$^3$) expanded polystyrene (EPS). By "substantially entirely" is meant that the interlocking concrete form module is formed entirely of EPS and does not include metallic attachment or rigidity-increasing elements. Obviously, elements that do not affect the ability of the modules to be cut, as described below, and that are used for purposes other than attachment or adding strength could be included.

The interlocking concrete form module 21 illustrated in FIGS. 1–5 has the general shape of a right rectangular parallelepiped. More specifically, the interlocking concrete form module 21 includes two parallel side walls 23*a* and 23*b* joined by two edge webs 25*a* and 25*a*, and three interior webs 27*a*, 27*b* and 27*c* all integral with the sides.

Figure 6:
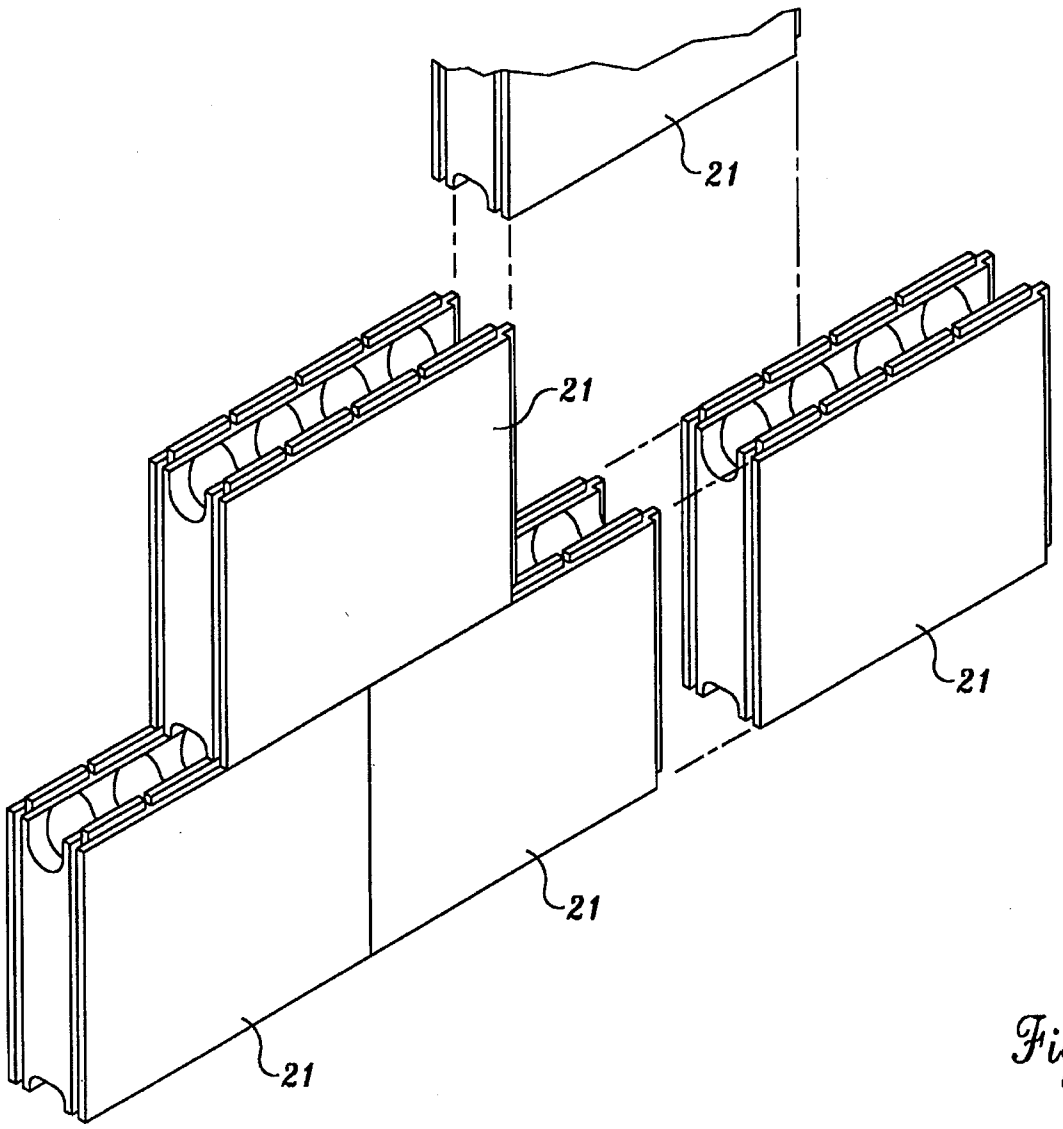
FIG. 6 is an assembly view illustrating a plurality of interlocking concrete form modules of the type illustrated in FIG. 1 interlocked with one another to create part of a concrete wall form.

The side walls 23*a* and 23*b* include outer surfaces 29 remote from the webs 25*a*, 25*b*, 27*a*, 27*b*, and 27*c*. The inner surfaces of the side walls 23*a* and 23b, and the webs 25*a*, 25*b*, 27*a*, 27*b*, and 27*c* define four cavities 31. Two of the cavities are defined by the end webs 25*a* and 25*b*, and the immediately adjacent interior webs 27*a* and 27*c*. The other two cavities 31 are defined by the side walls and the interior webs 27*a*, 27*b*, and 27*c*. The cavities 31 lie parallel to one another. When the interlocking concrete form modules are oriented in the way they are normally assembled, the cavities 31 are vertically oriented. See FIG. 6.

Two adjacent edges of each of the side walls 23*a* and 23*b* include a tongue 33*a* and 33*b*, and the other two adjacent edges each include a groove 35*a* and 35*b*. When normally oriented, one of the normal tongues 33*a* is located along the top edge of each of the side walls of the concrete form module 21, one of the a tongues 33*b* is located along one vertical edge of each of the side walls, one of the grooves 35*a* is located along the bottom edge of each of the side walls, and one of the grooves 35*b* is located along the other vertical edge of each of the side walls. The tongues 33*a* located along the top edges include notches 34 used to align and brace the modules in the manner illustrated in FIG. 12 and described below. Preferably, a notch 34 is aligned with each web.

Figure 5:
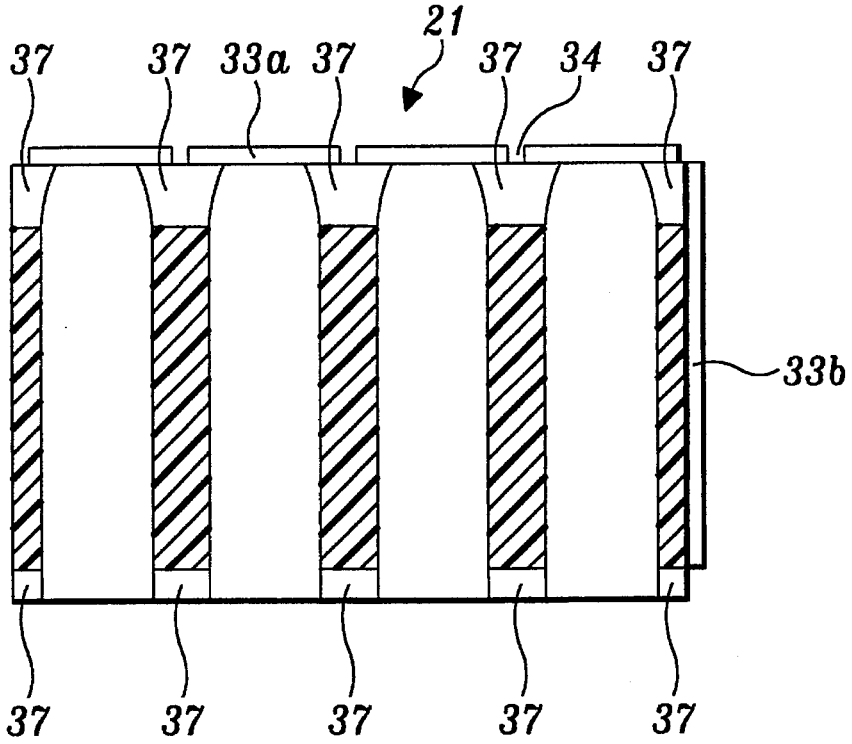
FIG. 5 is a cross-sectional view along line 5—5 of FIG. 2.

As shown best in FIGS. 1 and 5, the upper and lower ends of each of the webs 25*a*, 25*b*, 27*a*, 27*b*, and 27*c* is undercut to create a horizontal cavity between two adjacent interlocking concrete form modules when one is mounted atop the other. The horizontal cavities are shown best in FIG. 6, which illustrates a plurality of offset blocks joined together edge-to-edge and top-to-bottom such that vertical tongues 33*b* engage adjacent vertical grooves 35*b*, and such that horizontal tongues 33*a* engage adjacent horizontal bottom grooves 35*a*. While offset, the blocks are positioned such that the vertical cavities 31 are in vertical alignment.

Figure 3:
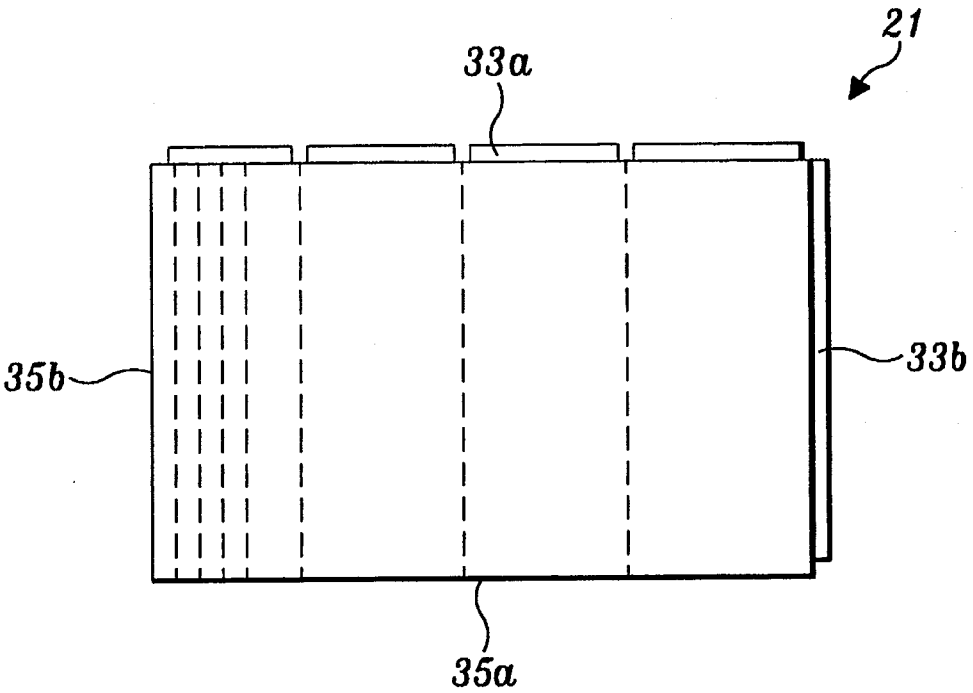
FIG. 3 is an elevational view of one side of the interlocking concrete form module illustrated in FIG. 1.

As best illustrated in FIGS. 1 and 3, preferably, vertical cut indicia lines 39*a*, 39*b*, 39*c* . . . are painted or scribed on one or both surfaces 29 of the interlocking concrete form modules. The cut indicia lines are associated with angles—15°, 30°, 45°, etc. The cut indicia are designed to be used to assist in cutting off the ends of the interlocking concrete form modules 21 on a bias toward an opposing corner so that two modules can be positioned adjacent to one another to create a comer. In this regard, FIG. 7 illustrates two interlocking concrete form modules 21 having one end cut at an angle of 45° to create a 90° comer in a wall when the concrete form modules are positioned adjacent to one another.

Figure 7:
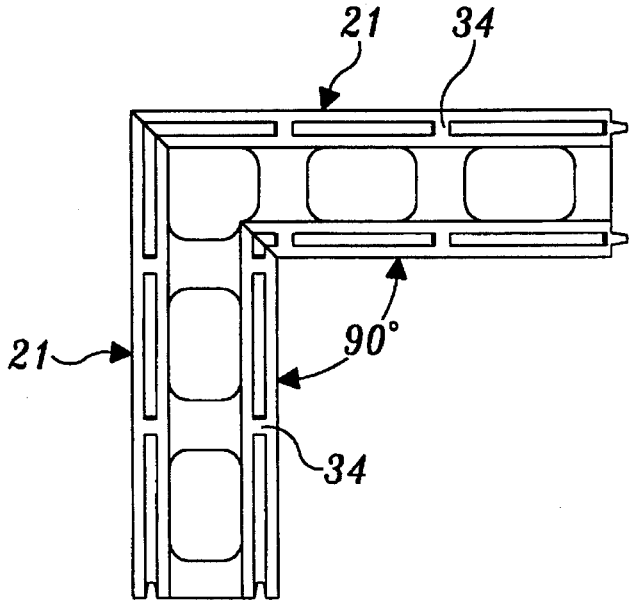
FIG. 7 is a top plan view of a pair of interlocking concrete form modules of the type illustrated in FIG. 1 cut and assembled together to create a 90° comer.

As noted above, the interlocking concrete form module 21 illustrated in FIGS. 1–7 and described above is substantially entirely formed of relatively dense (3–5 lb./ft.$^3$) expanded polystyrene (EPS). The insulation R-value of relatively dense EPS is about three percent (3%) greater than-low density EPS. Further, the strength of EPS of this density is adequate to hold threaded screw anchors of the type commonly used in the construction industry. As a result no furring strips or other attachment members are required in a wall using interlocking concrete form modules 21 of the type shown in FIGS. 1–7. Obviously reinforcing iron or mesh may be positioned in the cavities before concrete is poured in the cavities. As with prior art interlocking concrete form modules, the interlocking concrete form modules shown in FIGS. 1–7 are left in place after concrete is poured to provide insulation. The advantage of interlocking concrete form modules of the type shown in FIGS. 1–7 is their ability to be easily cut to different shapes to form, for example, comers as shown in FIG. 7 using readily available tools such as handsaws and hot wire cutters. No special or unusual tools are required as with interlocking concrete form modules having embedded reinforcement and attachment metal members, such as shown in U.S. Pat. No. 4,879,855.

Figure 8:
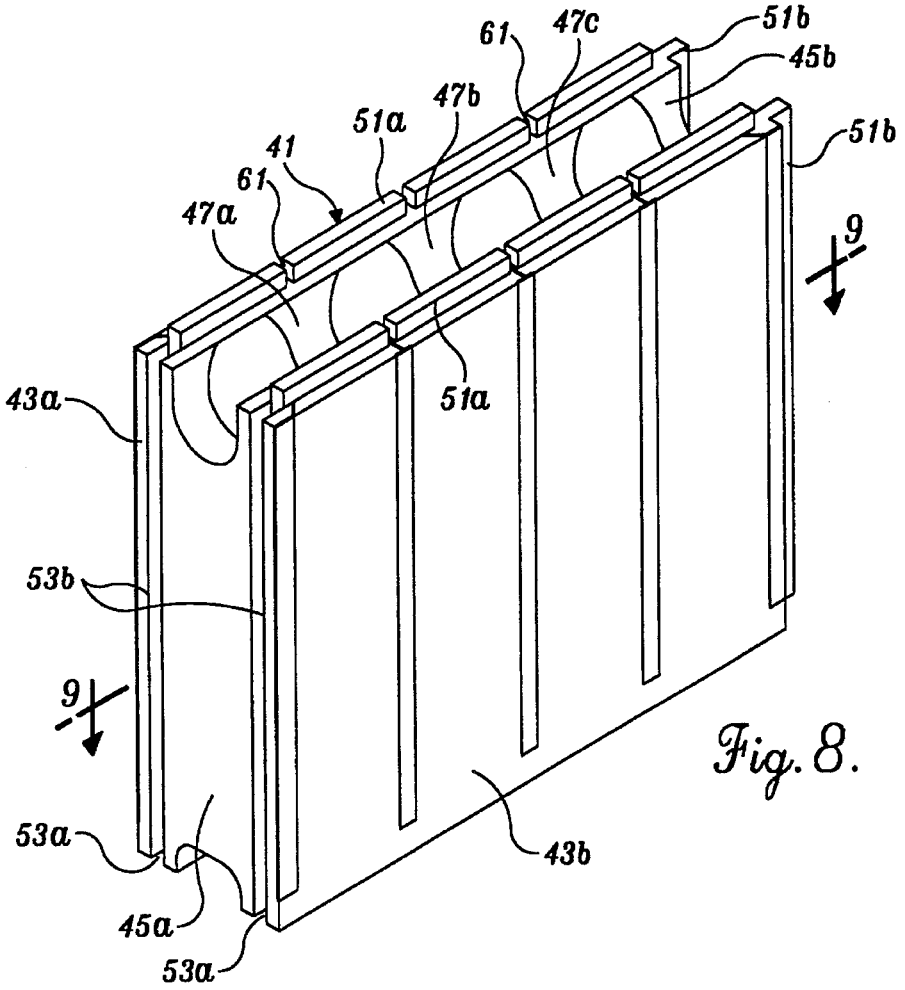
FIG. 8 is a pictorial view of an alternative embodiment of an interlocking form module formed in accordance with the invention.
Figure 9:
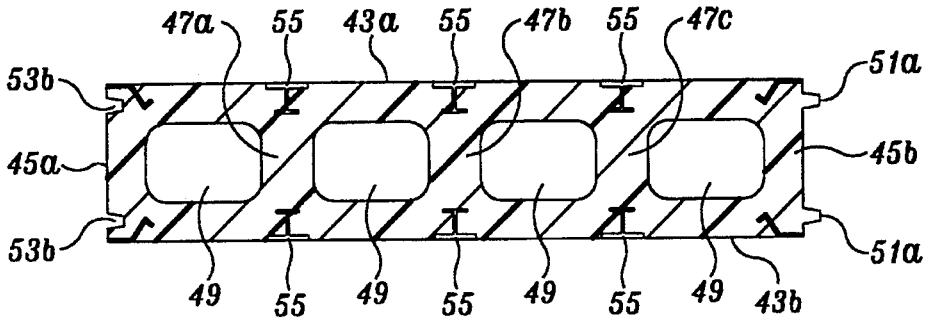
FIG. 9 is a cross-sectional view along line 9—9 of FIG. 8.

FIGS. 8 and 9 illustrate an alternative embodiment of the invention. More specifically, FIGS. 8 and 9 illustrate an interlocking concrete form module 41 having a peripheral configuration similar to the interlocking concrete form module 21 illustrated in FIGS. 1–7. That is, the interlocking concrete form module 41 illustrated in FIGS. 8 and 9 includes a pair of parallel side walls 43*a* and 43*b* joined by two end webs 45*a* and 45*b* and three interior webs 47*a*, 47*b*, and 47*c*. The side walls 43*a* and 43*b* and the webs 45*a*, 45*b*, 47*a*, 47*b*, and 47*c* define four cavities 49. When the interlocking concrete form modules 41 are suitably oriented, the longitudinal axes of the cavities 49 are vertical. The upper ends of the end webs 45*a* and 45*b* and the interior webs 47*a*, 47*b*, and 47*c* are undercut along their tops and bottoms. As a result, horizontal cavities are formed between adjacent blocks when suitably assembled in the manner illustrated in FIG. 12 and described below.

As with the interlocking concrete form module 21 illustrated in FIGS. 1–7, the interlocking concrete form module 41 illustrated in FIGS. 8 and 9 includes tongues 51*a* and 51*b* located along two adjacent edges of each of the side walls 43*a* and 43*b*. Grooves 53*a* and 53*b* are located along the other two adjacent edges of the side walls 43*a* and 43*b*. The tongues and grooves are designed to interlock with one another. One of the major differences between the interlocking concrete form module illustrated in FIGS. 8 and 9 and the interlocking concrete form modules illustrated in FIGS. 1–7 lies in the density of the expanded polystyrene (EPS) used to create the modules. As noted above, the EPS used to form interlocking concrete form modules 21 of the type illustrated in FIGS. 1–7 is relatively dense, i.e., the density is 3 lb./ft.$^3$ or greater, preferably, lying in the 3–5 lb./ft.$^3$ range. In contrast, the density of the EPS used in interlocking concrete form modules of the type illustrated in FIG. 9 is considerably less. The preferred density is approximately 1½ lb./ft.$^3$. Whereas the material strength of 3–5 lb./ft.$^3$ EPS is adequate to hold threaded anchors of the type used in the construction industry, the material strength of 1½ lb./ft.$^3$ is insufficient to hold conventional threaded anchors. Such threaded anchors are relatively easily removed by hand by manually pulling on the anchors. In contrast, threaded anchors cannot be easily removed by hand from 3–5 lb./ft$^3$ EPS.

In the past, the anchor problem in low-density EPS interlocking concrete form modules has been solved by embedding metal attachment members in the modules. See U.S. Pat. No. 4,879,855. The inclusion of metal attachment members is undesirable because it is difficult to cut such members on a bias to create a comer of the type shown in FIG. 7. While special comer modules can be used to avoid the need to cut modules to create a comer, special comer modules add to manufacturing costs, distribution costs, stocking costs, etc. Further, the U-shaped attachment strips shown in U.S. Pat. No. 4,879,855 easily became lost during transportation and can become detached during use. As shown in FIGS. 8 and 9, and described next, the invention overcomes these disadvantages by embedding extruded rigid, high impact PVC (or some other suitable plastic) attachment elements in the side walls 43*a* and 43*b* of the interlocking concrete form modules 41.

Figure 10:
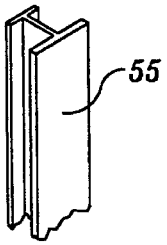
FIG. 10 is a pictorial view of a middle attachment element suitable for use in the embodiment of the invention illustrated in FIGS. 8 and 9.

Aligned with each interior web 47*a*, 47*b*, and 47*c* of the low-density EPS interlocking concrete form module 41 illustrated in FIGS. 8 and 9 is an attachment element 55 having an I-shaped cross-sectional configuration. A perspective view of one of the I-shaped attachment elements 55 is illustrated in FIG. 10. As shown there, one of the flanges 55*a* of the I-shaped attachment elements is wider and thicker than the other flange 55*b*. The I-shaped attachment elements are mounted such that the wider, thicker flange 55*a* of the I-shapes is coplanar with the outer surface of the associated side 43*a* or 43*b* of the interlocking concrete form module 41. The web 55*c* of the I projects inwardly in a direction orthogonal to the plane of the surface. The other flange 55*b* of the I-beam is embedded in the side wall 43*a* or 43*b* of the interlocking concrete form module 41.

Figure 11:
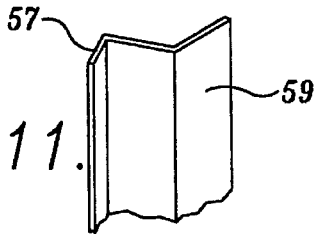
FIG. 11 is a pictorial view of an end attachment element suitable for use in the embodiment of the invention illustrated in FIGS. 8 and 9.

Located along each of the edges of the interlocking concrete form module 41 illustrated in FIGS. 8 and 9 is an edge attachment element 57. As shown in FIG. 11, the edge attachment elements have the cross-sectional configuration of a mathematical square root symbol. The edge attachment elements are oriented such that the "wing" 59 of the square root symbol that normally overlies the number whose square root is desired lies coplanar with the outer surface of the side wall 43*a* or 43*b* within which the end attachment element is embedded. The edge of wing 59 lies along the outer edge of the wall 43*a* or 43*b*. The V-shaped section of the square root symbol is embedded in the side wall of the interlocking concrete form module. Preferably, the wing is thicker than the V-shaped section.

Figure 12:
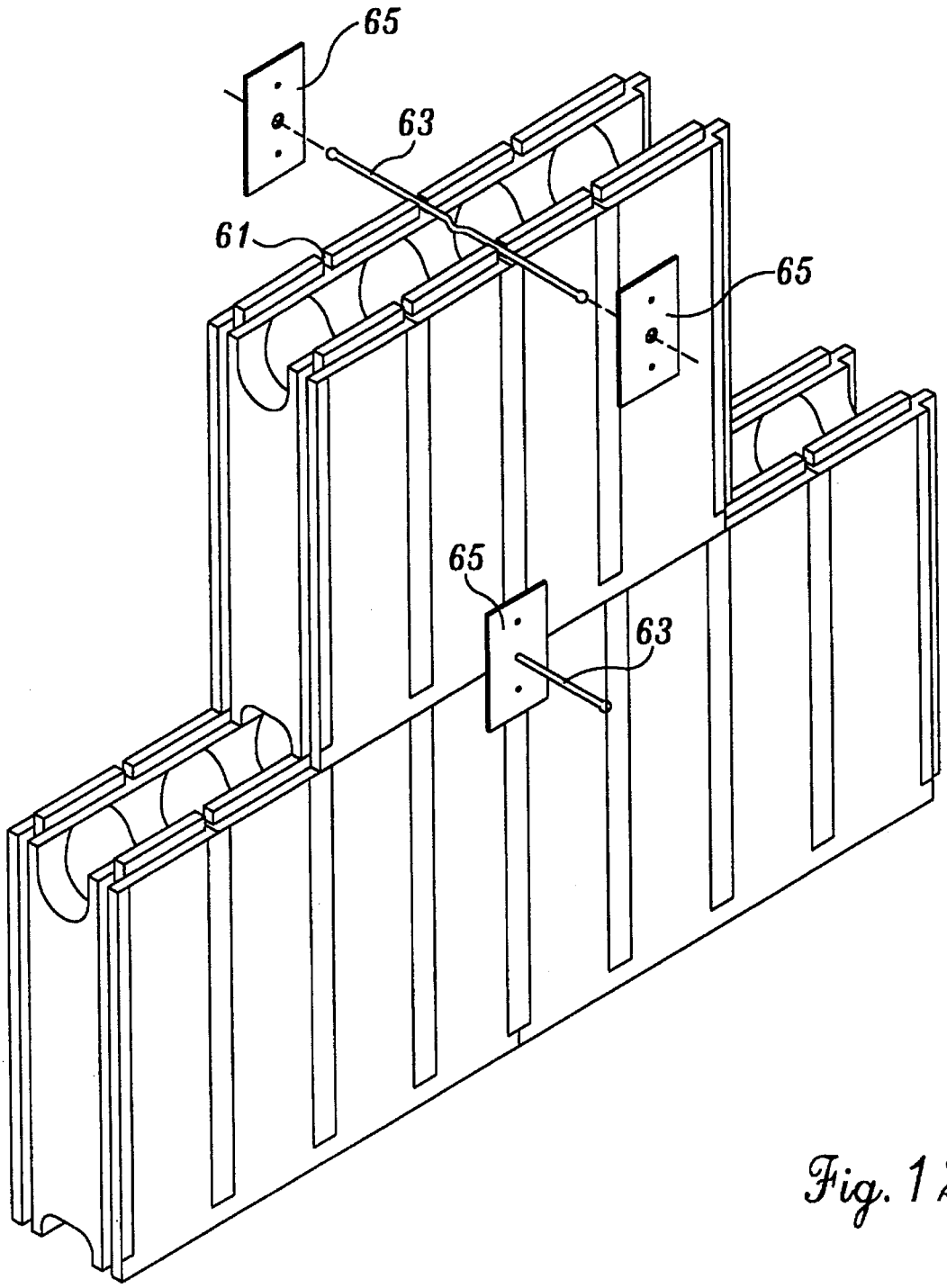
FIG. 12 is a pictorial view of a plurality of interlocking concrete form modules of the type illustrated in FIG. 1 showing a mechanism for assisting in aligning and bracings the modules during the construction of a wall.

As illustrated in FIG. 8, located in the horizontal tongues 51*a*, i.e., the tongue positioned along the horizontal edges of a normally positioned module 41, are notches 61. A notch 61 is aligned with the flange 55*c* of each of the I-beam attachment elements 55. As shown in FIG. 12, the notches 61 are provided to receive an elongate metal rod 63 of the type currently used with panel-type concrete wall forms. More specifically, one present construction technique for creating solid concrete walls is to use panels, such as three-quarter (¾) inch plywood panels. Spaced-apart panels are vertically oriented to create a concrete form. Reinforcing metal may be located between the panels. Extending across the panels, through holes in the panels, are elongate metal rods of the type shown in FIG. 12. The rods usually have a V-shaped center section and break indentations at the inner face of the panels. The outer ends of the rods are attached via a suitable well-known mechanism to vertical alignment members, such as wood 2×4 s. The vertical alignment members are suitably braced when concrete is poured between the panels. After the concrete has hardened, the panels are removed and the rods broken off at their break indentations. The notches 61 are provided to allow a similar mechanism to be used to align and brace a wall formed of interlocking concrete form modules formed in accordance with the invention. More specifically, as shown in FIG. 12 and noted above, a suitable number of similar elongate metal rods 63 are positioned in the notches so as to lie across the modules. The rods include break indentations where they exit the modules. Affixed to the modules either directly or indirectly via the furring strips are metal plates 65. The metal plates surround the rods and are attached to the furring strips by screws 67. The length of the portions 69 of the rods that extend outwardly from the metal plates are adequate to attach the rods to vertical alignment members using the same mechanism referred to above. The vertical alignment members are suitably braced when concrete is poured. After curing the bracing, vertical alignment members, attachment mechanisms, and metal plates are removed. Then the rods are broken off at their break indentations.

As also shown in FIG. 8, the interior and end attachment elements 55 and 57 extend from the bottom of the horizontal tongues 51*a* to the bottom of the grooves 53*a*. As a result, the attachment elements span substantially the entire height of the side walls of the interlocking concrete form modules 41 shown in FIGS. 8 and 9. Consequently, when the interlocking concrete form modules are suitably assembled to form a wall as shown in FIG. 13, the attachment elements 55 and 57 form furring strips that cover substantially the entire height of the wall. More specifically, when the interlocking concrete form modules 41 are suitably assembled in a 50% offset manner similar to the way concrete blocks and bricks are laid, the vertical cavities 49 are aligned with one another. As a result, the interior and edge attachment elements 55 and 57 are vertically aligned with one another. A set of vertically aligned attachment elements forms a furring strip that extends substantially the entire height of a wall, the only missing area being that covered by the horizontal interlocked tongue and grooves.

As will be readily appreciated from the foregoing description, the present invention provides interlocking concrete form modules suitable for forming concrete walls. The modules have the general shape of a right rectangular parallelepiped with parallel sides joined by integral webs that define a plurality of parallel elongate cavities. The edges of the sides include interlocking tongues and grooves that allow the modules to be interlocked to form a wall. The ends of the webs are undercut such that cavities between the modules are created when the modules are suitably interlocked. The between-the-module cavities lie orthogonal to the through-the-module cavities. The modules are formed of an insulating material and left in place. In one embodiment of the invention, the modules are formed of relatively dense expanded polystyrene (EPS). In another embodiment of the invention, the modules are formed of less dense EPS and include embedded nonmetallic attachment elements sized and positioned such that an outer surface of the attachment elements lies coplanar with the outer surfaces of a side wall of the modules. In either case, the modules are substantially entirely formed of nonmetallic materials that can be relatively easily cut by hand saws and hot wire cutting tools in a way that allows them to be readily combined to create comers in walls and flush ends.

While preferred embodiments of the invention have been illustrated and described, it is to be understood that within the scope of the amended claims, various changes can be made therein.

The embodiments of the invention in which an exclusive property or privilege is claimed are defined as follows:

1. An interlocking concrete form module comprising:

a pair of side walls, each of said side walls being substantially entirely formed of a nonmetallic material and including interlocking means located along the edges of said side walls;

a plurality of webs integral with, extending between and connecting said side walls, said webs formed substantially entirely of the same nonmetallic material as said side walls; and nonmetallic means for receiving and retaining threaded screw anchors, said nonmetallic means comprising a plurality of nonmetallic strips embedded in said side walls.

2. An interlocking concrete form module as claimed in claim 1 wherein the ends of said plurality of webs are undercut such that a cavity is formed between a pair of interlocking concrete form modules juxtaposed one above the other.

3. An interlocking concrete form module as claimed in claim 1 or 2 wherein said interlocking means includes tongues located along a pair of adjacent edges of each side wall and a pair of grooves located along the other pair of adjacent edges of each side wall and wherein the tongues located along one edge include notches.

4. An interlocking concrete form module as claimed in claim 3 wherein said notches are aligned with said webs.

5. An interlocking concrete form module as claimed in claim 1 or 2 wherein said nonmetallic attachment strips are embedded in each of said pair of side walls in alignment with each of said webs.

6. An interlocking concrete form module as claimed in claim 5 wherein said nonmetallic attachment strips include interior attachment strips and edge attachment strips.

7. An interlocking concrete form module as claimed in claim 6 wherein said interior attachment strips have an I-shaped cross-sectional configuration.

8. An interlocking concrete form module as claimed in claim 7 wherein said edge attachment strips have the cross-sectional configuration of a mathematical square root symbol.

9. In an interlocking concrete form module comprising a pair of side walls and a plurality of webs integral with, extending between and connecting said side walls, said webs and said side walls formed substantially entirely of the same material, said side walls and integral webs defining a plurality of parallel cavities, each of said side walls including interlocking means located along the edges of the side walls, the improvement comprising said interlocking concrete form module being formed substantially entirely of a nonmetallic material and including in said side walls nonmetallic attachment strips having a density adequate to receive and retain threaded screw anchors.

10. The improvement claimed in claim 9 wherein sad nonmetallic attachment are embedded in each of said pair of side walls in alignment with each of said webs.

11. The improvement claimed in claim 9 or 10 wherein said interlocking means comprises tongues located along two adjacent edges of said side walls and grooves located along the other two adjacent edges of said side walls and wherein said improvement includes notches in the tongue located along one edge of said side walls.

12. The improvement claimed in claim 11 wherein said notches are aligned with said webs.

13. The improvement claimed in claim 10 wherein said nonmetallic attachment strips include interior attachment strips and edge attach strips.

14. The improvement claimed in claim 13 wherein said interior attachment strips have an I-shaped cross-sectional configuration.

15. The improvement claimed in claim 14 wherein said edge attachment strips have the cross-sectional configuration of a mathematical square root symbol.

* * * * *

UNITED STATES PATENT AND TRADEMARK OFFICE

CERTIFICATE OF CORRECTION

PATENT NO. : 5,465,542

DATED : November 14, 1995

INVENTOR(S) : V.O. Terry

It is certified that error appears in the above-indentified patent and that said Letters Patent is hereby corrected as shown below:

TITLE PAGE:

| Item [54] (Pg. 1, col. 1) | Title | "INTERBLOCKING" should read --INTERLOCKING-- |
|---|---|---|
| **COLUMN** | **LINE** | |
| 1 | 1 | "INTERBLOCKING" should read --INTERLOCKING-- |
| 1 | 25 | After "FOR" delete --,-- |
| 1 | 42 | "$ft^3$" should read --$ft.^3$-- |
| 1 (three occurrences) | 62 | "comers" should read --corners-- |
| 2 | 1 | "comer" should read --corner-- |
| 2 | 43 | "comer" should read --corner-- |
| 2 | 66 | "requiting" should read --requiring-- |
| 3 | 19 | "alter" should read --after-- |
| 3 | 29 | "comers" should read --corners-- |

UNITED STATES PATENT AND TRADEMARK OFFICE

CERTIFICATE OF CORRECTION

PATENT NO. : 5,465,542
DATED : November 14, 1995
INVENTOR(S) : V.O. Terry

It is certified that error appears in the above-indentified patent and that said Letters Patent is hereby corrected as shown below:

| COLUMN | LINE | |
|---|---|---|
| 3 | 38 | "alter" should read --after-- |
| 3 | 43 | "comers" should read --corners-- |
| 3 | 47 | "alter" should read --after-- |
| 4 | 11 | "comer" should read --corner-- |
| 4 | 26 | "bracings" should read --bracing-- |
| 4 | 50 | "25a" (second occurrence) should read --25b-- |
| 5 | 29 | "comer" should read --corner-- |
| 5 | 31 | "comer" should read --corner-- |
| 5 | 53 | "comers" should read --corners-- |
| 6 | 38 | "comer" should read --corner-- |
| 6 | 39 | "comer" should read --corner-- |
| 6 | 40 | "comer" (both occurrences) should read --corner-- |
| 8 | 27 | "comers" should read --corners-- |

UNITED STATES PATENT AND TRADEMARK OFFICE

CERTIFICATE OF CORRECTION

PATENT NO. : 5,465,542

DATED : November 14, 1995

INVENTOR(S) : V.O. Terry

It is certified that error appears in the above-indentified patent and that said Letters Patent is hereby corrected as shown below:

| COLUMN | LINE | |
|---|---|---|
| 9 (Claim 10, | 20 line 1) | "sad" should read --said-- |
| Drawings | -- | FIGURE 13 has been erroneously omitted. |

Signed and Sealed this

Eleventh Day of June, 1996

*Attest:*

Bruce Lehman

BRUCE LEHMAN

*Attesting Officer*

*Commissioner of Patents and Trademarks*